United States Patent [19]

Mueller

[11] 4,418,457

[45] Dec. 6, 1983

[54] APPARATUS AND PROCESS FOR EXPANDING TO JOIN A TUBE INTO A TUBE SHEET OPENING

[75] Inventor: Richard A. Mueller, Tulsa, Okla.

[73] Assignee: Cities Service Company, Tulsa, Okla.

[21] Appl. No.: 341,048

[22] Filed: Jan. 21, 1982

[51] Int. Cl.[3] ..... B23P 15/26; B21D 39/04; B21D 39/08

[52] U.S. Cl. ..... 29/157.4; 29/421 R; 29/523; 29/727; 29/237; 72/58

[58] Field of Search ..... 29/157.4, 157.5, 421 R, 29/523, 727, 237; 72/58

[56] References Cited

U.S. PATENT DOCUMENTS

| | | | |
|---|---|---|---|
| 2,535,403 | 12/1950 | Froggatt | 72/58 X |
| 3,432,916 | 3/1969 | Fisher et al. | 29/523 X |
| 4,006,619 | 2/1977 | Anderson | 72/58 X |
| 4,068,372 | 1/1978 | Kamohara et al. | 72/58 |
| 4,152,821 | 5/1979 | Scott | 29/237 X |
| 4,235,013 | 11/1980 | Vallmer | 72/58 X |
| 4,320,568 | 3/1982 | Herrod et al. | 29/421 R |
| 4,343,170 | 8/1982 | Hufton | 29/421 R X |
| 4,387,507 | 6/1983 | Kelly | 29/421 R X |

FOREIGN PATENT DOCUMENTS

| | | | |
|---|---|---|---|
| 482191 | 4/1927 | Fed. Rep. of Germany | 72/58 |

*Primary Examiner*—Charlie T. Moon

*Attorney, Agent, or Firm*—Robert H. Sproule; John W. Carpenter; George L. Rushton

[57] ABSTRACT

A process and apparatus for joining a tube into a tube sheet opening. After a tube is inserted into a tube sheet opening, compression and subsequent radial expansion of an elastomeric material inside the tube causes the elastomer to radially expand the tube wall creating an interference fit between the tube and inner wall of the tube sheet opening. A portion of the elastomer positioned exterior to the tube sheet face expands to a greater radial diameter than the portion of the elastomer within the tube sheet opening resulting in radial expansion of the tube wall toward the tube sheet face to create a sealing effect between the tube and tube sheet.

12 Claims, 5 Drawing Figures

FIG. 1
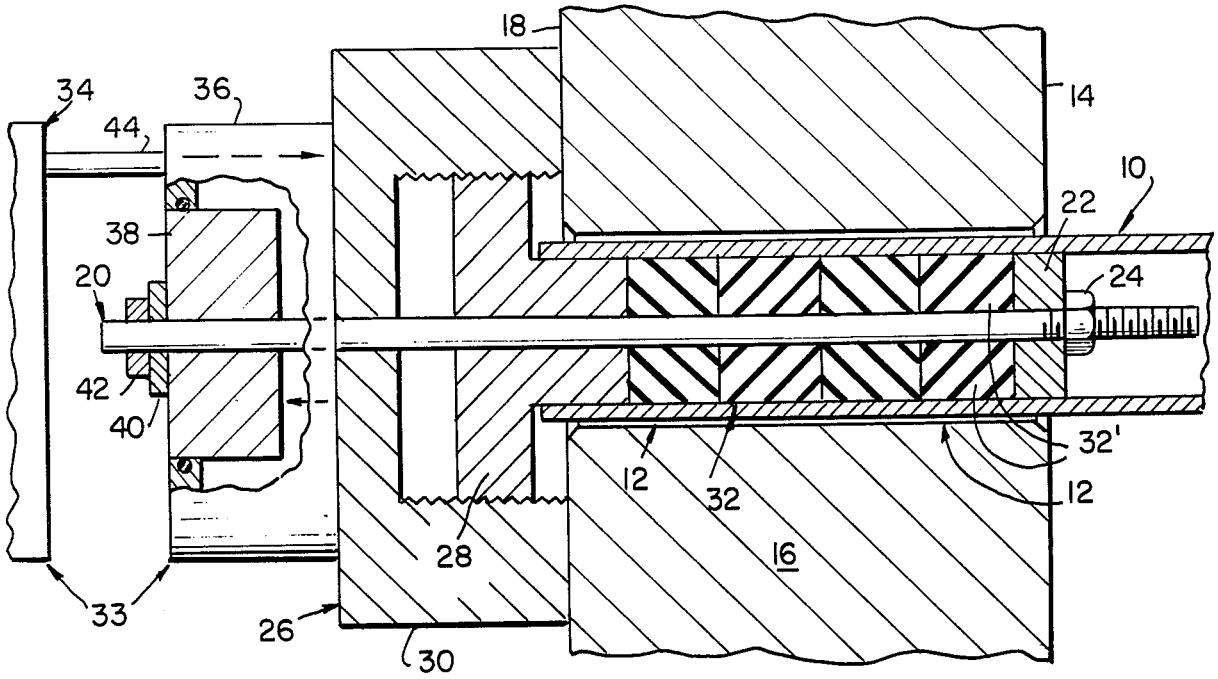
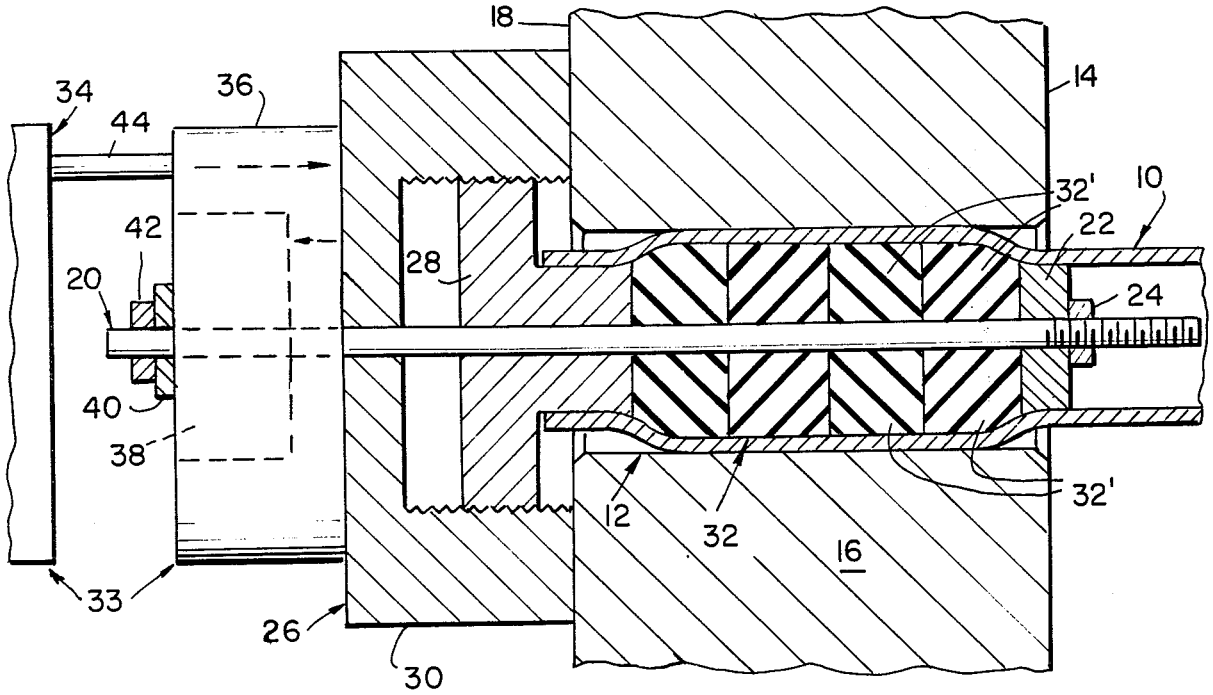
FIG. 2

FIG. 3
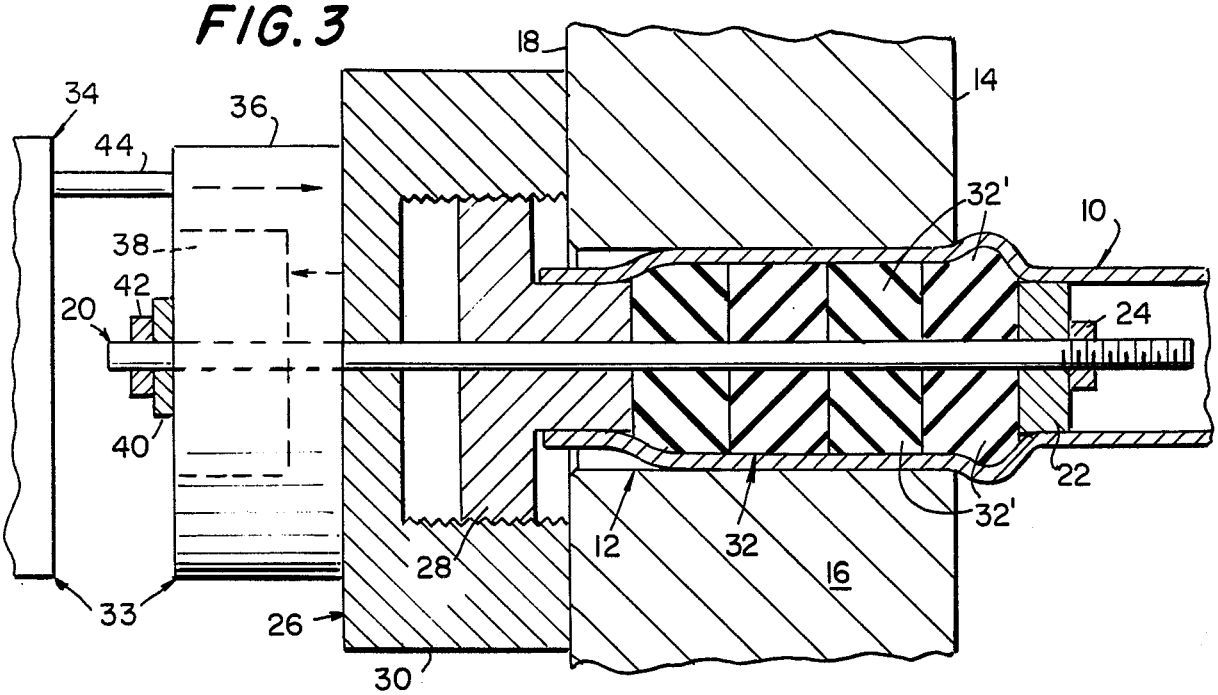
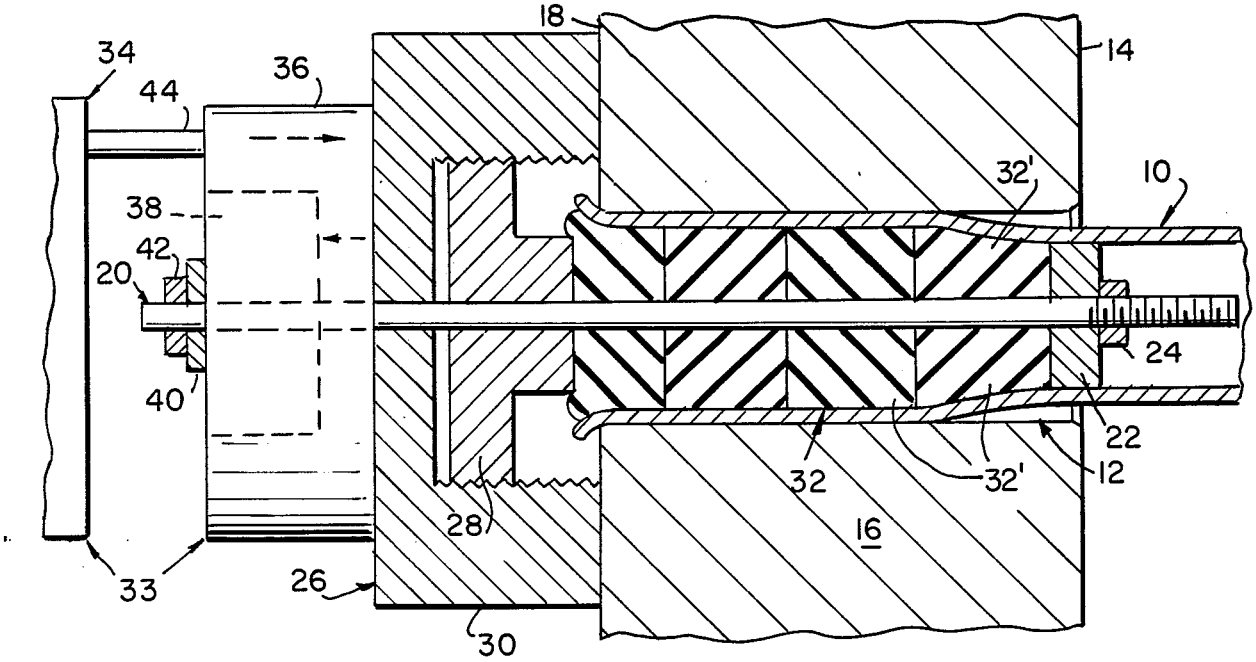
FIG. 4
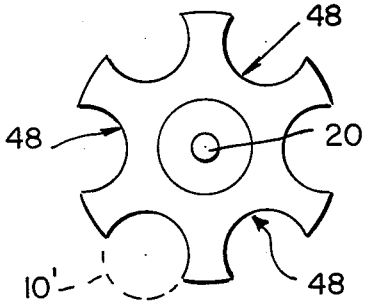
FIG. 5

APPARATUS AND PROCESS FOR EXPANDING TO JOIN A TUBE INTO A TUBE SHEET OPENING

BACKGROUND OF THE INVENTION

1. Field of the Invention

The present invention relates to an apparatus and process involving the compression and subsequent radial expansion of an elastomeric material against the inside surface of a tube causing expansion of the tube wall against the inner surface of the tube sheet opening to create an interference fit between the tube wall and the surface of the tube sheet opening. More particularly, the apparatus and process of the present invention involve the use of movable end caps which position a portion of the elastomeric material exterior to the tube sheet opening which upon radial expansion seal the tube to the tube sheet.

2. Description of the Prior Art

Prior art tube expanders, such as U.S. Pat. No. 4,006,619 by Anderson and U.S. Pat. No. 4,068,372 by Kamohara, et. al., are incapable of positioning the elastomeric material outside of the tube sheet opening. The above apparatus fail to properly seal the tube to the tube sheet thereby allowing corrosive fluids to seep between the tube wall and the wall of the tube sheet opening. My invention overcomes the disadvantages of prior art methods by providing an apparatus which allows radial expansion of a portion of the elastomeric material exterior to the tube sheet opening, thereby sealing the wall of the tube to the corner of the tube sheet opening. In addition, in my invention the adjustable end caps are removable and may be replaced by other end caps of different sizes to fit within different sized tubes.

SUMMARY OF THE INVENTION

The present invention accomplishes its desired objects by broadly providing an apparatus and process for expanding to join a tube into an opening of a tube sheet. The apparatus comprises a tube mated within the tube sheet opening such that the majority of the tube is exterior to and generally perpendicular to the inner face of the tube sheet. A shaft extends axially inside the tube and an inner cap is bound to one end of the shaft for longitudinal axial movement in combination with the shaft with respect to the tube. An inner collar cap is slidably mounted on and along the shaft in proximity to the tube sheet opening at the tube sheet outer face. An elastomeric means is slidably mounted on and along the shaft between the inner cap and the inner collar cap within the tube sheet opening for longitudinal axial movement on and along the shaft with respect to the tube. An outer locating collar abutting the outer face of the tube sheet in proximity to the tube sheet opening is connected to the inner collar cap such that the inner collar cap may be substituted by other inner collar caps of different diameters, and such that the position of the inner collar cap may be adjusted within the outer locating collar along the longitudinal axis of the shaft. Also included in the invention is a means for pulling the shaft in one axial direction while simultaneously pushing the outer locating collar in the opposite axial direction against the outer face of the tube sheet. When the inner end cap and the inner collar cap contact the elastomeric means, the continuing respective axial forces from pulling and pushing compress and subsequently radially expand the elastomeric means against the inside of the tube causing the tube to expand outwardly against the inner surface of the tube sheet opening to form an interference fit between the tube wall and the inner surface of the tube sheet opening.

The process for expanding to join the tube to the tube sheet opening comprises mating the tube with the tube sheet opening, aligning the shaft axially inside the tube, mounting the elastomeric means slidably on and along the shaft within the tube sheet opening, mounting the inner collar cap slidably on and along the shaft, and connecting the outer locating collar to the inner collar cap such that the outer locating collar abuts the outer face of the tube sheet. The outer locating collar is connected to the inner collar cap such that the inner collar cap may be substituted by other inner collar caps of different sizes and such that the position of the inner collar cap may be adjusted within the outer locating collar along the longitudinal axis of the shaft. The process also includes pulling the shaft in one axial direction while simultaneously pushing the outer locating collar in the opposite axial direction against the outer face of the tube sheet in order to compress and subsequently radially expand the elastomeric means against the inside of the tube, thereby causing the tube to expand outwardly against the inner surface of the tube sheet opening to form an interference fit between the tube wall and the inner surface of the tube sheet opening.

It is therefore an object of the present invention to provide a process and apparatus for radially expanding to join a tube into a tube sheet opening.

It is another object of the present invention to provide a process and apparatus for radially expanding to join a tube into various sized tube sheet openings.

It is another object of the present invention to provide a process and apparatus to seal the tube to the corner of the tube sheet opening at the tube sheet inner face, tube sheet outer face, or both.

These together with various ancillary objects and features which will become apparent as the following description proceeds, are obtained by this novel apparatus and process, preferred embodiments being shown in the accompanying drawings, by way of example only, wherein:

BRIEF DESCRIPTION OF THE DRAWINGS

FIG. 1 is a longitudinal cross-section of the apparatus before expansion inside a tube sheet opening;

FIG. 2 is a longitudinal cross-section of the apparatus after expansion inside a tube sheet opening;

FIG. 3 is a longitudinal cross-section of the apparatus inside a tube sheet opening wherein a portion of the tube extending beyond the inner face of the tube sheet is expanded to overlap toward the inner face of the tube sheet;

FIG. 4 is a longitudinal cross-section of the apparatus inside a tube sheet opening wherein a portion of the tube extending beyond the outer face of the tube sheet is expanded to overlap toward the outer face of the tube sheet; and FIG. 5 is an end view of a locating collar having a scalloped outer surface in order to clear other tubes that may protrude from the tube sheet outer face in proximity to the locating collar.

DETAILED DESCRIPTION OF THE INVENTION

Referring in detail now to the drawings wherein like or similar parts of the invention are identified by like reference numerals, FIG. 1 defines a tube generally illustrated as 10 mated within a tube sheet opening generally illustrated as 12 such that the majority of the length of tube 10 is exterior from and generally perpendicular to inner face 14 of the tube sheet generally illustrated as 16. Inner face 14 of tube sheet 16 is by definition that face of the tube sheet from which the majority of the length of tube 10 extends. Outer face 18 of tube sheet 16 is by definition that face of the tube sheet opposite to inner face 14. Generally tube 10 may consist of any metal capable of being expanded.

A shaft generally illustrated as 20 extends axially inside tube 10. Shaft 20 has an end cap 22 bound thereto by nut 24 for longitudinal axial movement in combination with shaft 20 with respect to tube 10. End cap 22 is bound to that end of shaft 20 closest to tube sheet inner face 14 and hereinafter is referred to as inner end cap 22. The minimum diameter of shaft 20 is limited by the yield strength of the metal alloy used in its construction, but it is normally one-third the diameter of the tube.

A collar means generally illustrated as 26 is slidably mounted on and along shaft 20 so as to permit longitudinal axial movement of shaft 20 with respect to tube 10. The collar means as depicted in FIG. 1 includes inner collar cap 28 and outer locating collar 30. Inner collar cap 28 is slidably mounted on and along shaft 20 in proximity to the tube sheet opening 12 at tube sheet outer face 18. Outer locating collar 30 is attached to inner collar cap 28 and abuts tube sheet outer face 18 in proximity to tube sheet opening 12. Inner collar cap 28 and outer locating collar 30 are connected such that inner collar cap 28 may be removed and replaced with inner collar caps of different sizes to allow expansion of different diameters of tubes 10. Prior art is deficient in this area having no means for easily expanding tubes with different diameters because the locating collar and outer cap are generally one piece construction. In addition, FIG. 1 illustrates inner collar cap 28 attached to outer locating collar 30 such that the position of inner collar cap 28 may be adjusted within outer locating collar 30 along the longitudinal axis of shaft 20, thereby allowing inner collar cap 20 to be adjusted along the longitudinal axis of shaft 20. By threadably screwing inner collar cap 28 within outer locating collar 30, inner collar cap 28 may be substituted or adjusted within outer locating collar 30 as needed.

An elastomeric means generally illustrated as 32 is slidably mounted on and along shaft 20 between inner end cap 22 and inner collar cap 28 of collar means 26 for longitudinal axial movement of shaft 20 with respect to tube 10. Elastomeric means 32 is positioned within the walls of tube sheet opening 12 and may comprise a plurality of individual plugs 32' which are capable of being substituted on shaft 20. The number and width of plugs 32' determine the length of tube expansion along the longitudinal axis of tube 10. In addition, inner collar cap 28 may be adjusted within outer locating collar 30 to accommodate the length of elastomeric means 32 to be compressed. The shortest length of elastomeric means will be generally ½ inch; the longest length will be generally three times the tube sheet thickness. Elastomeric means 32 may consist of any elastomer, although an elastomer having a high resilience such as hard urethane rubber is preferred. Shaft 20, inner end cap 22, inner collar cap 28 and outer locating collar 30 are composed of a material having a greater strength and hardness than elastomeric means 32, such as AISI 4340.

In addition a push-pull means generally illustrated as 33 is used for pulling shaft 20 in one axial direction while simultaneously pushing outer locating collar 30 in the opposite axial direction. The push-pull means 33 may comprise a pump means generally illustrated as 34 and a combination outer cylinder 36 and inner cylinder 38. Inner cylinder 38 is located inside outer cylinder 36 such that the longitudinal axes of both cylinders are concentrically aligned. Shaft 20 extends through outer cylinder 36 and inner cylinder 38 along their respective longitudinal axes. Shaft 20 is secured to inner cylinder 38 by end cap 40 and nut 42. Fluid is delivered under pressure from pump 34 through fluid conduit 44 into outer cylinder 36. The pressurized fluid acting against the inner surface of outer cylinder 36 transmits a push force through locating collar 30 and end cap 28 to elastomeric means 32, while at the same time the fluid acting against the outer surface of inner cylinder 38 transmits a pull force through cap 40 to shaft 20. Shaft 20 is then pulled in a leftward axial direction when viewing in FIG. 2, while outer locating collar 30 is simultaneously pushed in the opposite axial direction against tube sheet outer face 18, a rightward direction when viewing FIG. 2, such that inner collar cap 28 and inner end cap 22 contact the respective ends of elastomeric means 32. When inner end cap 22 and inner collar cap 28 contact elastomeric means 32, the respective continuing axial forces from pulling and pushing compress and subsequently radially expand elastomeric means 32 against the inside of tube 10 as depicted in FIG. 2. The expansion of elastomeric means 32 against the inside of tube 10 causes tube 10 to expand outwardly against the inner surface of tube sheet opening 12 to form an interference fit between the wall of tube 10 and the inner surface of tube sheet opening 12. Upon reversal of the push-pull process, elastomeric means 32 relaxes, allowing shaft 20 in combination with inner end cap 22, inner collar cap 28 and elastomeric means 32 to be withdrawn from tube 10. After expansion tube 10 will conform to the shape of tube sheet opening 12 even if tube sheet opening 12 is not perfectly round. Elastomeric means 32 when confined acts like a fluid and forces are generated normal to all surfaces which confine the material thereby radially expanding the tube into the out of round opening.

In order that the compression forces of inner collar cap 28 and inner end cap 22 are fully transmitted to elastomeric means 32, the outer edge of inner collar cap 28, and the outer edge of inner end cap 22 are generally sized to conform to the size and shape of the inner surface of tube 10. Therefore application of compression forces over the entire end surface of elastomeric means 32 assures that maximum compression and radial expansion axis of elastomeric means 32 is achieved. The outer surface of elastomeric means 32 may also conform to the shape and size of the inner surface of tube 10 in which elastomeric means 32 is inserted. The expansion forces remain normal to the surface of the wall of tube 10 when elastomeric means 32 in its non-compressed state conforms to the shape of the inside wall of tube 10. Conforming elastomeric means 32 to the size and shape of tube 10 results in uniform expansion forces against the wall of tube 10 upon compression of elastomeric means 32 thereby creating a uniformly tight seal between tube 10 and the inner surface of tube sheet opening 12.

In one embodiment of the invention as depicted in FIG. 3, elastomeric means 32 extends within tube 10 from inside tube sheet opening 12 to a location exterior to and in proximity with tube sheet inner face 14. A portion of the elastomeric means 32 is positioned exterior to tube sheet inner face 14 by screwing nut 24 in a direction away from the sheet inner face 14 thereby moving it in a rightward direction when viewing FIG. 3, and then screwing end collar cap 28 toward tube sheet outer face 18, a rightward direction when viewing FIG. 3, thereby forcing elastomeric means 32 and inner end cap 22 in a rightward direction until end cap 32 abuts nut 24. An additional elastomeric plug 32' may be inserted between inner end cap 22 and inner collar cap 28 to provide for additional longitudinal expansion of elastomeric means 32 against the entire inner surface area of tube sheet opening 12. Upon compression of elastomeric means 32, the portion of tube 10 encompassing elastomeric means 32 exterior from tube sheet opening 12 at tube sheet inner face 14 is expanded to a greater diameter than the portion of tube 10 interior to tube sheet opening 12 causing the wall of tube 10 exterior to tube sheet opening 12 to overlap toward tube sheet inner face 14, and thereby sealing the wall of tube 10 to the corner of tube sheet opening 12 at tube sheet inner face 14. This sealing helps exclude corrosive fluids from the tube wall-tube sheet opening interface.

In another embodiment of the invention as depicted in FIG. 4, tube 10 when mated with tube sheet opening 12 extends through tube sheet opening 12 to a position exterior to and in proximity with tube sheet outer face 18. A portion of the elastomeric means 32 is positioned exterior to tube sheet outer face 18 by screwing end collar cap 28 within outer locating collar 30 away from tube sheet outer face 18, a leftward direction when viewing FIG. 4, and then screwing nut 24 toward tube sheet inner face 14 a leftward direction when viewing FIG. 4, thereby forcing inner end cap 22 and elastomeric means 32 in a leftward direction until elastomeric means 32 abuts inner collar cap 28. An additional elastomeric plug 32' may be inserted on shaft 20 between inner end cap 22 and inner collar cap 28 to provide for expansion of elastomeric means 32 against the entire inner surface area of tube sheet opening 12. When inner end cap 22 and inner collar cap 28 compress elastomeric means 32 resulting in radial expansion of elastomeric means 32 against the inside of tube 10, the portion of tube 10 encompassing elastomeric means 32 exterior to tube sheet opening 12 is expanded to a greater diameter than the portion of tube 10 interior to tube sheet opening 12. The expansion of elastomeric means 32 exterior to tube sheet opening 12 causes the wall of tube 10 exterior to tube sheet opening 10 to overlap toward tube sheet outer face 18 thereby sealing the wall of tube 10 to the corner of tube sheet opening 12 at tube sheet outer face 18. The sealing of tube 10 to the corner of tube sheet opening 12 creates a mechanical lock thereby increasing the resistance of tube 10 to pull out from tube sheet 16. If desired, the wall of tube 10 can be expanded toward tube sheet inner face 14 and tube sheet outer face 18 at the same time by insertion of elastomeric means 32 [or elastomeric plugs 32'] having sufficient length to extend beyond both inner face 14 and outer face 18 concurrently when inside tube sheet opening 12.

In another embodiment of the present invention as depicted in FIG. 5, locating collar 30 includes one or more semi-circular scallops generally illustrated as 48 formed into the outer surface of locating collar 30 parallel to the longitudinal axis of shaft 20. Scallops 48 are formed in locating collar 30 such that other tubes 10' protruding from tube sheet outer face 18 in proximity to locating collar 30 mate with scallops 48 thereby allowing locating collar 30 to clear tubes 10' and to abut against tube sheet outer face 18 in proximity to tube sheet opening 12. When the center to center spacing of the holes in tube sheet 16 is large in relationship to the diameter of tube 10, locating collar 30 need not be scalloped.

While the present invention has been described herein with reference to particular embodiments thereof, a latitude of modification, various changes and substitutions are introduced in the foregoing disclosure, and in some instances some features of the invention will be employed without a corresponding use of other features without departing from the scope of the invention as set forth.

We claim:

1. An apparatus for radially expanding to join a tube into an opening of a tube sheet, including an inner face and outer face thereof, comprising:

(a) a tube mated within the tube sheet opening such that the majority of the length of the tube is exterior from and generally perpendicular to the inner face of the tube sheet;

(b) a shaft extending axially inside the tube;

(c) an inner end cap bound to one end of the shaft for longitudinal axial movement in combination with the shaft with respect to the tube;

(d) an inner collar cap slidably mounted on and along the shaft in proximity with the tube sheet opening at the tube sheet outer face;

(e) an elastomeric means slidably mounted on and along the shaft within the tube sheet opening between the inner end cap and the inner collar cap for longitudinal axial movement on and along the shaft with respect to the tube;

(f) an outer locating collar abutting the outer face of the tube sheet in proximity with the tube sheet opening, said outer locating collar connected to the inner collar cap such that the inner collar cap may be substituted by other inner collar caps of different diameters, and such that the position of the inner collar cap may be adjusted within the outer locating collar along the longitudinal axis of the shaft; and (g) a means for pulling the shaft in one axial direction while simultaneously pushing the outer locating collar in the opposite axial direction against the outer face of the tube sheet, such that when the inner end cap and the outer locating collar contact the elastomeric means the respective continuing axial forces from pulling and pushing compress the elastomeric means against the inside of the tube causing the tube to expand outwardly against the inner surface of the tube sheet opening to form an interference fit between the tube wall and the inner surface of the tube sheet opening.

2. The apparatus for radially expanding to join a tube into an opening of a tube sheet as recited in claim 1 wherein said inner collar cap is threadably connected to said outer locating collar.

3. The apparatus for radially expanding to join a tube to an opening of a tube sheet as recited in claim 1 wherein the elastomeric means prior to compression extends within the tube from inside the tube sheet opening to a location exterior to the tube sheet opening at the inner face of the tube sheet, such that upon compression of the elastomeric means the portion of the tube encompassing the elastomeric means exterior from the tube sheet opening at the inner face is radially expanded to a greater diameter than the portion of the tube interior to the tube sheet opening, thereby causing the tube wall exterior to the tube sheet opening to overlap toward the inner face of the tube sheet at the tube sheet opening.

4. The apparatus for radially expanding to join a tube to an opening of a tube sheet as recited in claim 1 wherein:

(a) the tube when mated with the tube sheet opening extends through the tube sheet opening to a position exterior from and in proximity therewith at the outer face of the tube sheet;

(b) the inner collar cap of the collar means is located exterior to and in proximity with the tube sheet opening at the outer face thereof; and (c) the elastomeric means prior to compression extends within the tube from inside the tube sheet opening to a location exterior to and in proximity with the tube opening at the outer face of the tube sheet, such that when the inner end cap and the inner collar cap compress and subsequently radially expand said elastomeric means against the inside of the tube the portion of the tube encompassing the elastomeric means exterior to the tube sheet opening is radially expanded to a greater diameter than the portion of the tube interior to the tube sheet opening, thereby causing the tube wall exterior to the tube sheet opening to overlap toward the outer face of the tube sheet at the tube sheet opening.

5. The apparatus for radially expanding to join a tube to an opening of a tube sheet as recited in claim 1 wherein the locating collar includes a plurality of semicircular scallop means formed into the outer surface of said outer locating collar parallel to the longitudinal axis of the shaft such that other tubes protruding from the outer face of the tube sheet in proximity with said locating collar mate with said scallop means, thereby allowing said locating collar to abut against the outer face of the tube sheet.

6. The apparatus for radially expanding to join a tube to an opening of a tube sheet as recited in claim 1 wherein the elastomeric means comprises a plurality of substitutable elastomeric plugs, the number and width of said elastomeric plugs so mounted on and along the shaft determinative of the length of tube expansion along the longitudinal axis of the tube.

7. A process for radially expanding to join a tube to an opening of a tube sheet, including an inner face and an outer face thereof, said process comprising the following steps:

(a) mating a tube within the tube sheet opening such that the majority of the length of tube is exterior from and generally perpendicular to the inner face of the tube sheet;

(b) aligning a shaft axially inside of said tube, said shaft having an inner end cap bound thereto for longitudinal axial movement in combination with the shaft with respect to the tube;

(c) mounting an elastomeric means slidably on and along the shaft within the tube sheet opening for longitudinal axial movement on and along the shaft with respect to the tube;

(d) mounting an inner collar cap slidably on and along the shaft in proximity to the tube sheet opening at the tube sheet outer face, said inner collar cap positioned on and along the shaft such that said elastomeric means is between said inner collar cap and said inner end cap;

(e) positioning an outer locating collar such that said outer locating collar abuts the outer face of the tube sheet in proximity with the tube sheet opening, said outer locating collar connected to the inner collar cap such that the inner collar cap may be substituted by other inner collar caps of different diameters, and such that position of the inner collar cap may be adjusted within the outer locating collar along the longitudinal axis of the shaft; and (f) pulling the shaft in one axial direction while simultaneously pushing the outer locating collar in the opposite axial direction against the outer face of the tube sheet, such that when the inner end cap and the inner collar cap contact the elastomeric means the continuing respective axial forces from pulling and pushing compress and subsequently radially expand the elastomeric means against the inside of the tube, thereby causing the tube to expand radially against the inner surface of the tube sheet opening to form an interference fit between the tube wall and the inner surface of the tube sheet opening.

8. The process for radially expanding to join a tube into an opening of a tube sheet as recited in claim 7 additionally comprising threadably connecting said inner collar cap to said outer locating collar.

9. The process for radially expanding to join a tube to an opening of a tube sheet as recited in claim 7 additionally comprising positioning the elastomeric means prior to compression within the tube to extend from inside the tube sheet opening to a location exterior to and in proximity with the tube sheet opening at the inner face of the tube sheet, such that upon compression of the elastomeric means the portion of the tube encompassing the elastomeric means exterior from the tube sheet opening at the inner face is radially expanded to a greater diameter than the portion of the tube interior to the tube sheet, thereby causing the tube wall to overlap toward the inner face of the tube sheet at the tube sheet opening.

10. The process for radially expanding to join a tube to an opening of a tube sheet as recited in claim 7 additionally comprising:

(a) positioning the tube such that when mated with the tube sheet opening said tube extends through the tube sheet opening to a position exterior from and in proximity therewith at the outer face of the tube sheet;

(b) positioning the inner collar cap of the collar means exterior to and in proximity with the tube sheet opening at the outer face thereof; and (c) positioning the elastomeric means prior to compression such that said elastomeric means extends within the tube from inside the tube sheet opening to a location exterior from and in proximity with the tube sheet opening at the outer face of the tube sheet, such that when the inner end cap and the inner collar cap compress and subsequently radially expand said elastomeric means against the inside of the tube, the portion of the tube encompassing the elastomeric means exterior to the tube sheet opening is radially expanded to a greater diameter than the portion of the tube interior to the tube sheet opening, thereby causing the tube wall exterior to the tube sheet opening to overlap toward the outer face of the tube sheet at the tube sheet opening.

11. The process for radially expanding to join a tube to an opening of a tube sheet as recited in claim 7 additionally comprising forming into the outer surface of the locating collar a plurality of semi-circular scallop means, said scallop means formed parallel to the longitudinal axis of the shaft such that other tubes protruding from the outer face of the tube sheet mate with said scallop means allowing the locating collar to abut against the outer face of the tube sheet.

12. The process for radially expanding to join a tube to an opening of a tube sheet as recited in claim 7 additionally comprising segmenting the elastomeric means into a plurality of substitutable elastomeric plugs, the number and width of said elastomeric plugs so mounted on and along the shaft determinative of the length of tube expansion along the longitudinal axis of the tube.

* * * * *